US006299473B1

(12) United States Patent
Schwarz et al.

(10) Patent No.: US 6,299,473 B1
(45) Date of Patent: Oct. 9, 2001

(54) ELECTRICAL CONNECTOR, PARTICULARLY FOR MOTOR VEHICLES

(75) Inventors: Uwe Schwarz, Ettlingen; Helmut Zischka, Weissach, both of (DE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/308,083

(22) PCT Filed: Dec. 11, 1997

(86) PCT No.: PCT/DE97/02652

§ 371 Date: Dec. 21, 1999

§ 102(e) Date: Dec. 21, 1999

(87) PCT Pub. No.: WO98/21069

PCT Pub. Date: May 22, 1998

(30) Foreign Application Priority Data

Nov. 12, 1996 (DE) ..... 196 46 716

(51) Int. Cl.[7] ..... H01R 4/24
(52) U.S. Cl. ..... 439/404
(58) Field of Search ..... 439/492, 499, 439/456, 459, 473

(56) References Cited

U.S. PATENT DOCUMENTS

| | | | | |
|---|---|---|---|---|
| 4,006,957 | * | 2/1977 | Narozny | 339/103 |
| 4,012,093 | * | 3/1977 | Crane | 339/17 |
| 4,060,295 | * | 11/1977 | Tomkiewicz | 339/17 |
| 4,358,177 | * | 11/1982 | Badolato | 339/103 |
| 4,886,942 | * | 12/1989 | Lenz et al. | 174/135 |
| 4,948,379 | * | 8/1990 | Evans | 439/329 |
| 5,199,896 | * | 4/1993 | Mosquera | 439/329 |
| 5,344,338 | * | 9/1994 | Colleran et al. | 439/465 |

* cited by examiner

*Primary Examiner*—Brian Sircus
*Assistant Examiner*—Thanh-Tam Le

(57) ABSTRACT

In order that, in the case of an electrical connector for establishing a connection to at least one conductor essentially arranged in a flexible foil, having a dielectric housing with a receptacle for the insertion of the flexible foil and of the at least one conductor, costs are reduced yet the quality of the said connector is improved, at least one contact pin for establishing electrical contact with the at least one conductor is provided, the contact pin exerting a force on the electrical conductor and/or the flexible foil, which force both ensures that the conductor bears mechanically on the contact pin, and ensures the provision of an electrical contact.

23 Claims, 3 Drawing Sheets

ELECTRICAL CONNECTOR, PARTICULARLY FOR MOTOR VEHICLES

DESCRIPTION

Figure 1:
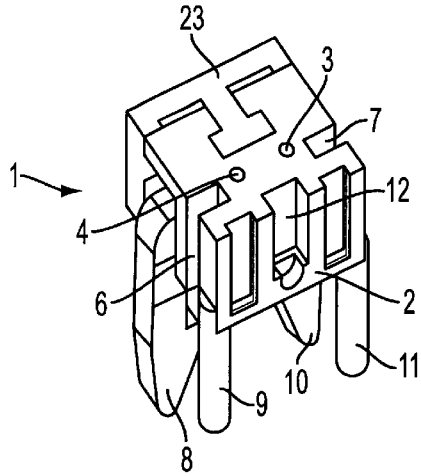

The invention relates to an electrical connector in accordance with the preamble of claim 1, and also to a method for establishing an electrical connection in accordance with the preamble of claim 16.

Electrical connectors are being used in ever more diverse ways, in particular in the motor vehicle sector, fox establishing electrical connections between the different functional units. The increasing propagation of electronics in motor vehicles is accompanied by a rise in the demand for reliable electrical connection paths in order to connect the different assemblies to one another permanently and reliably. However, diverse interfering influences occur in the harsh environment of use, influences that may consist, by way of example, in high temperature fluctuations, severe vibrations, dust or dirt, condensation moisture and consequential corrosion.

As competition increases in the market for motor vehicles, there is increasing pressure on the production costs, reduction of which must not entail any losses in quality or in the lasting durability. Consequently, continuous attempts have been made to achieve further improvements in the field of electrical lead-routing and also contact-making. The transition from individually laid leads or preformed bundles of leads to foil conductors, which are also referred to as Flex Foils, brought significant advances, in particular in the field of the indication instruments and fittings of motor vehicles such flexible foils, in which, as a rule, a plurality of electrical conductors are arranged in a planar manner, are, on the one hand, insusceptible to vibration and, on the other hand, can also be used under extremely difficult conditions by virtue of their bending capabilities and also the free configurability of the conductor arrangement. Furthermore, it is possible to dimension contact banks which are designed to be congruent with corresponding connections on the fittings or printed circuit boards. However, conventional methods for establishing an electrical connection for these conductors are time-consuming and cost-intensive. As a rule, the contact areas of the Flex Foils have been connected both electrically and mechanically by soldering. What is particularly detrimental In this case is that vibration forces introduced into soldered connections tend to break open the latter or moisture precipitates in extremely fine cracking, which moisture can lead to the beginnings of corrosion.

Consequently, the invention is based on the object of avoiding the disadvantages described above and of providing a cost-effective electrical connector that is simple to connect and also a corresponding method for establishing an electrical connection. The intention is, moreover, to establish a high-quality and permanent electrical connection with the least outlay on assembly.

This object is achieved, in a surprisingly simple manner, by means of the features of Claims 1 and 16.

If a force is exerted by at least one contact pin for establishing electrical contact with it least one conductor, which force both ensures that the conductor bears mechanically on the contact pin, and ensures the provision of an electrical contact, it is thereby possible generally to dispense with soldered connections. The bearing of the contact pin can take place, in principle, in a region which is completely free of the flexible foil or which, for example, is coated with the foil on the rear side of the conductor. Furthermore, partial regions of the front contact area of the conductor may also be coated with foil, as long as at least exposed windows of the conductor remain for contact with the contact pin.

If the contact pin penetrates the electrical conductor, or the electrical conductor and a section of the flexible foil, in such a way that an essentially defined flexure of the conductor and/or of the flexible foil is produced, it is possible to generate predefined bending moments with restoring forces assigned thereto, which lie at least partly within the elastic bending region of the conductor and/or of the foil. As a result of this, vibrations or shocks introduced into the foil can be elastically absorbed, without any interruption of the conductive connection. A connection which is actually uninterrupted over time is of great advantage especially in the field of digital signal transmission, where signal edges in the nanoseconds range are used to acquire signal contents.

If, with the contact pin assembled, the conductor or the conductor together with the flexible foil is emplaced both on the contact pin and on an annular shoulder of the dielectric housing of the connector, a predefined rounding of the annular shoulder makes it possible to reliably avoid kinking and also to create a soft tapering-off of a preferably funnel-shaped flexure of the conductor and also of the flexible foil. A funnel-shaped flexure is greatly advantageous since initially elastic restoring forces are provided in every direction of the plane of the foil and, furthermore, a displacement in the axial direction can initially be absorbed elastically by a widening of the funnel angle and consequentially by a harmless displacement of the conductor relative to the contact pin.

What is advantageous, however, is a device for mechanically holding the conductor or the foil together with the conductor, by means of which the conductor is mechanically held in the receptacle on an essentially annular region when the contact pin is driven in. If this device for the purpose of holding comprises a lateral shoulder, which, when the contact pin is pressed in, is pressed downwards and to the side in such a way that a press fit is brought about between the electrical conductor and/or the receptacle, it is also possible to completely absorb vibration forces in the axial direction. Furthermore, it is possible, at the same time, to create within the press fit a closed-off volume which permanently precludes the ingress of moisture or dirt and also subsequent corrosion at the location of the electrical contact.

In a preferred manner, admittedly, the contact pin is pressed, during assembly, through an opening or thinned portion, assigned to the said contact pin, in the foil in such a way that the said contact pin, when in the assembled state, is seated in a funnel-shaped, widened opening or opened thinned portion in the foil. However, it the contact pin is designed such that it ends conically or in a pointed fashion, in an alternative configuration according to the invention it is possible, similarly to the case with insulation-piercing terminals, for the said contact pin also to be driven through any desired region of the elastic foil with the electrical conductor embedded therein in such a way that both the foil and the conductor are punctured and the corresponding dimensioning of the diameter of the contact pin produces the desired defined force conditions between electrical conductor and contact pin.

It is advantageous, furthermore, to provide a second device for strain relief, which is preferably arranged such that it is displaceable in the same direction as the contact pin, this second device for strain relief producing a defined flexure of the flexible foil which, in a particularly preferred refinement, effects deflection through 90 degrees. As a result of this, impulses or vibrations proceeding in the plane of the foil art virtually no longer transmitted to its angular end with which contact has been made.

Furthermore, it lies within the scope of the invention to configure the connection of the foil in an L-shaped fashion, with the result that the bend between the limbs of the L leads to a further reduction in the transmission of mechanical forces.

In a particularly preferred refinement of the invention, both the contact pin and the second device for strain relief are assigned a preassembled position in which the said pin and device are held by latching into place or static friction and from which both can be brought into their assembled position in a common direction. An adhesion-locking retention of the contact pin in a channel, assigned thereto, inside the dielectric housing of the connector and also a latching element on the rider of the second strain-relief means, which provides a resistance to unintentional closure in its preassembled position, have proven particularly worthwhile for this purpose.

A further extremely desirable simplification of the assembly of the electrical connector results from the latter having holder devices for positionally fixing and permanently securing the connector on an assigned circuit board, the holder devices projecting on the underside of the housing of the connector with their longitudinal axis in the displacement direction of the contact pin and their ends which are remote from the housing carrying latching means which can establish a latching connection to a circuit board or an assigned receptacle. This makes it possible to fit the connector simply by pressing it at its desired assembly location.

If those ends of the holding devices of the connector which are remote from the housing have conical regions, this results in a self-centring effect, which improves the automation as well as the manufacturing reliability.

If the electrical connector furthermore has a lateral transport mount which can be released by displacement of its housing, all of the assembly steps, namely removal of the connector from its assembly mount, establishment of an electrical contact with encapsulation of the resulting contact region, mechanical retention, closing of a first and second strain-relief means, fitting of the electrical connector at its final assembly location and also establishment of an electrical connection between the connector and a printed circuit board, can be carried out in a single work step. In this case, the electrical contact between connector and printed circuit board or assigned fitting can be established by driving the contact pins into plated-through openings in the printed circuit board or fitting.

Figure 2:
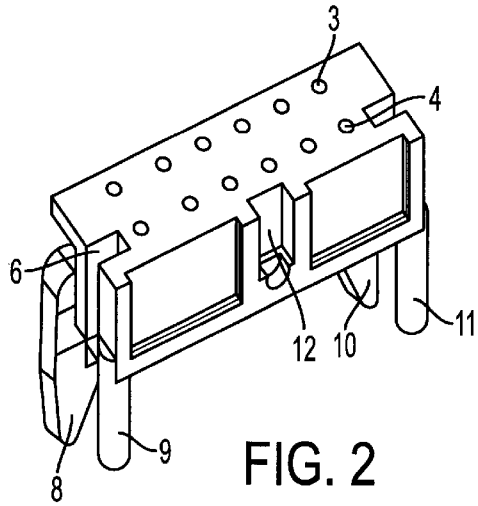
Figure 3:
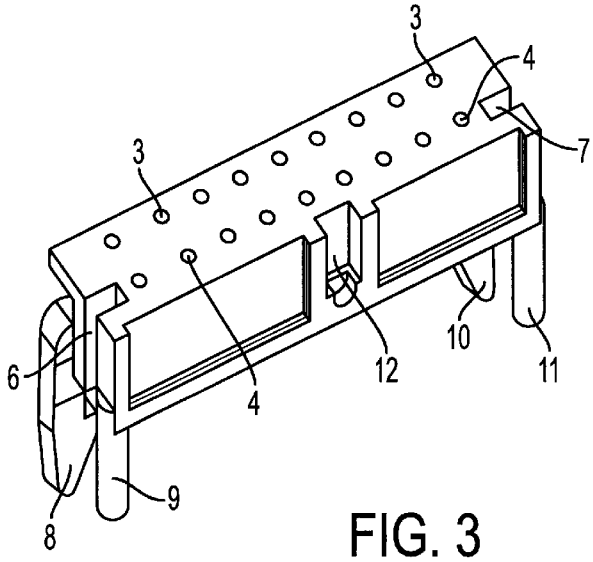
Figure 6:
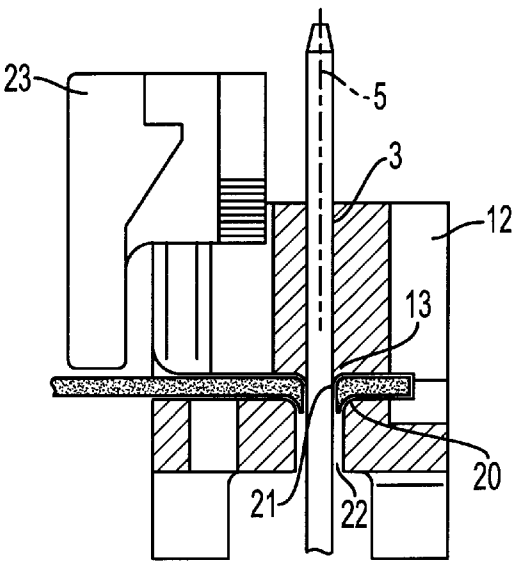
Figure 5:
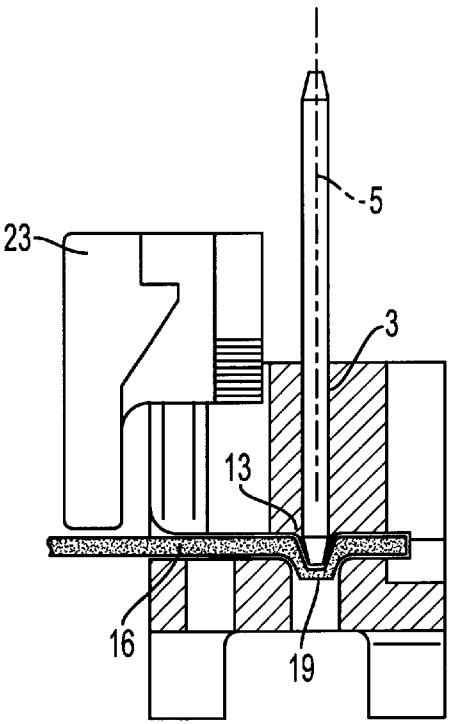
Figure 4:
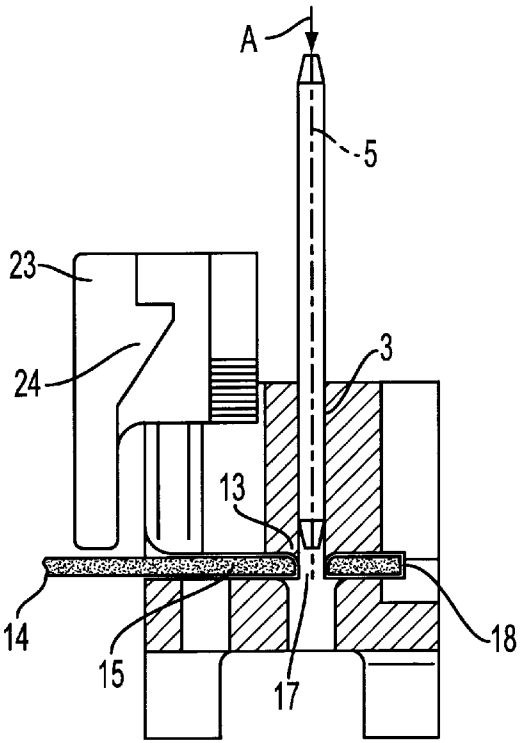
Figure 8:
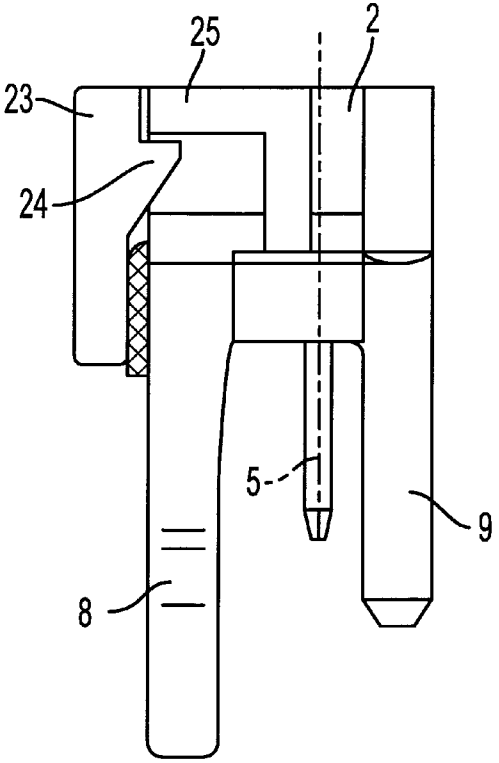
Figure 7:
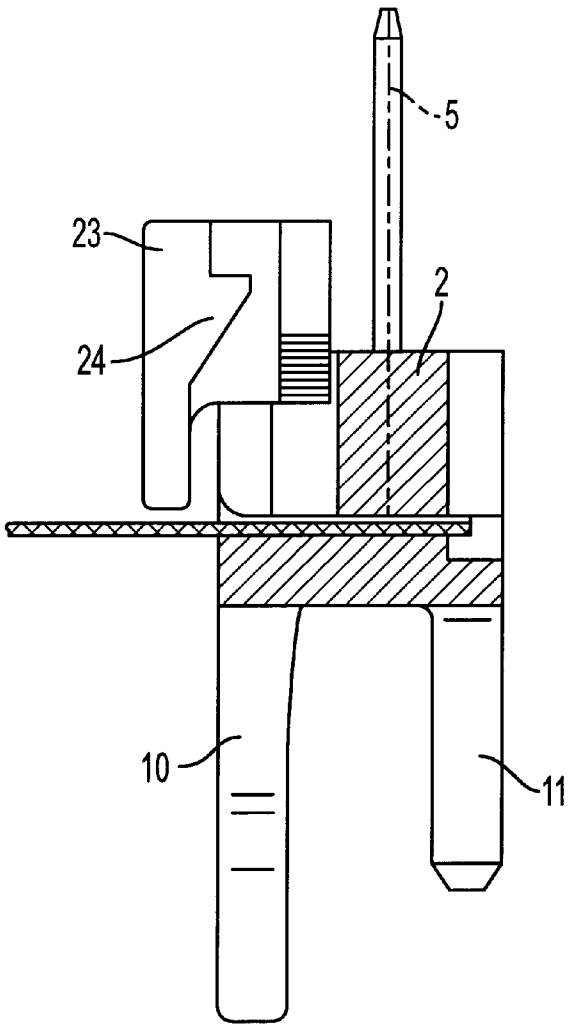

The invention is described in more detail below using preferred embodiments and with reference to the accompanying drawings:

In the figures:

FIG. 1 shows a perspective view of a first embodiment of the electrical connector in accordance with the invention, FIG. 2 shows a perspective view of a second embodiment of the electrical connector in accordance with the invention, FIG. 3 shows a perspective view of a third embodiment of the electrical connector in accordance with the invention, FIG. 4 shows a cross section taken in the region of the contact pin in the dielectric housing with the rider of the second strain-relief means and the contact pin in each case arranged in the preassembled position, FIG. 5 shows a cross section in accordance with FIG. 4 in which the first strain-relief means has been brought into its assembled or strain-relieving state and initial electrical contact has been established between the contact pin and the conductor, FIG. 6 shows a cross section in accordance with FIG. 4 in which the contact pin has passed completely through the electrical conductor and electrical contact with the conductor has been established, FIG. 7 shows a cross-sectional view in a plane which is offset parallel to FIG. 4 outside the channel for the contact pin, and FIG. 8 shows a side view of the electrical connector according to the invention with the second strain-relief means closed.

In order to afford a better understanding, identical or similar component parts are designated by the same reference symbols in the following detailed description.

In the following text, reference is first of all made to FIG. 1, in which the connector according to the invention, which is designated by 1 as a whole, can be seen in a perspective illustration obliquely from above. The dielectric housing 2 which is preferably produced by injection-molding, has two essentially cylindrical channels 3, 4 for receiving a respective contact pin 5. The channels 3, 4 comprise at least one region having a defined diameter within which the contact pin 5 is held with defined static friction.

At the ends of its two long sides, the dielectric housing 2 forms guide channels 6, 7 which are open towards the side and can be held in an assigned transport mount with defined static friction or by latching into place, in order to form a transport mount for the connector 1 in this way. The transport mount can be released by displacement in the displacement direction of the contact pin 5, the said displacement direction being represented by the arrow A in FIG. 4.

Holding devices 8, 9, 10, 11 for positionally fixing and permanently securing the connector on a circuit board or receptacle (not illustrated in the figures), which has openings assigned to the holding devices 8, 9, 10, 11, extend underneath the housing 2. The longitudinal axes of the holding devices 8, 9, 10, 11 likewise extend in the displacement direction designated by the arrow A, that end of the holding devices 8 and 10 which is remote from the housing carrying latching means which can establish a latching connection to the circuit board (not illustrated) or assigned receptacle. This latching is established by the connector 1 being inserted into the assigned openings or receptacles in the direction designated by the arrow A.

Although holding devices are illustrated only at the ends of the long sides in FIGS. 1, 2 and 3, it lies within the scope of the invention, in the case of embodiments having a large nure of contact pins 5, also to provide holding devices for holding the connector 1 in the centre or at a plurality of locations of the housing 2.

Further embodiments according to the invention can be found in FIGS. 2 and 3; these embodiments are intended to accommodate respectively 12 or 18 contact pins 5 in their channels 3, 4.

A depression 12 is situated on the front side of the housing 2 and serves either to stabilize or to centre the housing 2 in a transport receptacle, which is not illustrated in the figures, or else can be used for a tool for pushing the housing 2 out of the transport mount into its final fixed position.

Furthermore, the depression 12, which exposes a portion of the receptacle 16, can also be used to perform both optical and mechanical and/or electrical detection of the position of the flexible foil 14 on the stop 18.

In the following text, reference is made to FIGS. 4 to 6, which illustrate the operation of establishing electrical contact and also of closing the first strain-relief means 13 with subsequent encapsulation of the contact region 14. When the contact pin 5 is pressed down in the direction of the arrow A, its bottom conical or pointed end encounters the first strain-relief means 13, which is designed as an annularly circumferential shoulder which constricts the inside width of the channel 3. The flexible foil 14 with the electrical conductor 15 arranged therein is inserted into the slot-type receptacle 16 in such a way that an opening 17 in the conductor 15 and foil 14 is arranged concentrically under the channel 3.

This arrangement can be achieved in a simple manner by corresponding configuration of the flexible foil, in which case the foil both bears on an end stop 18 and is centred by lateral boundaries (not illustrated in the figures) of the slot-type receptacle 16.

As illustrated in FIG. 5, the downwardly passing contact pin 5 widens the annular first strain-relief means 13 downwards and to the side in such a way that the flexible foil 14 with the conductor 15 situated therein is pressed on the bottom side of the slot-type receptacle 16, thereby producing a fixed mechanical support between the flexible foil 14 and the receptacle 16 of the housing 2. In a further refinement of the invention, this press fit may provide a sealing and encapsulating function.

Upon continuation of the downward driving of the contact pin 5, the bottom conical end of the latter may enter the opening 17 in the flexible foil 14 and electrical conductor 15 in such a way as to produce the funnel-shaped deformation of the foil 14 and also of the electrical conductor 15 as illustrated in FIG. 6.

When the contact pin 5 is driven in, the foil 14 then bears, on the lower side thereof, on the annular shoulder 20, which has a defined rounding in order, in this way, to produce a predefined deformation which is adapted in each case to the flexible foil 14 and also to the electrical conductor 15. Furthermore, as a result of this, cracking and bending ruptures can be avoided, on the one hand, and, on the other hand, it is possible to produce a defined elastic flexure whose restoring forces, within the contact region 21, ensure that the electrical conductor 15 always reliably bears on the contact pin 5.

Furthermore, it lies within the scope of the invention to use, instead of the opening 17, a thinned region 19 without an opening 17 with a contact pin 5 tapering to a point, the pointed bottom end of which contact pin itself cuts an opening into the foil 14 and the conductor 15. In this case, the selection of the diameter of the contact pin 5 and also the thickness of the foil 14 and of the conductor 15 may be co-ordinated with one another in such as way that the resulting contact region 21 provides the desired, ever reliable bearing of the conductor 15 on the contact pin 5.

In a further alternative refinement according to the invention, the lower end of the channel 3 has a constriction 22, which ensures tight or sealing bearing on the contact pin 5, with the result that the contact region 21 is essentially hermetically sealed with respect to the outside.

If the contact pin 5 is driven further downwards with a wide flat tool, the tool enters the region of the top edge of the rider 23, which forms part of the second strain-relief means, and will displace the said rider downwards together with the contact pin 5.

In the preassembled position of the rider 23 and of the contact pin 5 as illustrated in FIG. 4, both the rider and the pin are secured against downward displacement. The static friction of the contact pin 5 keeps the latter reliably in the channel 3 and the wedge-shaped approach face of the latching lug 24 of the rider 23 bears on the housing 2.

The rider 23 has a cross-sectionally T-shaped region which faces the contact pin 5 and is arranged such that it is longitudinally displaceable in the direction of the arrow A in a likewise T-shaped recess in the housing 2.

If the assembly tool advances further with its flat bottom surface in the direction of the arrow A, then, as illustrated in FIGS. 7 and 8, the rider 23 is pushed into its lower latched position, in which the latching lug 24 engages behind a section 25 of the housing 2 which is essentially L-shaped in cross section.

In the assembled position of the contact pin 5 and also of the rider 23 as illustrated in FIG. 8, the flexible foil 14 with the conductors 15 arranged therein is deflected through essentially 90 degrees, in which case vibrations or shocks within the foil 14 and the conductor 15 art practically no longer transmitted into the interior of the housing 2. In a further refinement according to the invention, the flexible foil 14 with the conductor 15 arranged therein may have an L-shaped section which, on account of its deflection through 90 degrees again significantly reduces the transmission of vibrations or shocks.

In the assembled position as illustrated in FIG. 8, the contact pin 5 has been displaced such that it protrudes downwards front the housing 2, with the result that the contact pin 5 can pass through a circuit board (not illustrated in the figures) with plated-through openings arranged therein with tight radial bearing. Subsequently, depending on the further refinement according to the invention, a soldered connection to the contact pin 5 can be produced or radial elastic restoring forces of the plated-through opening may already provide reliable electrical contact. Vibrations or forces progressing perpendicularly to the longitudinal axis of the contact pin 5 can be reliably absorbed by the holding devices 8, 9, 10, 11 of the housing 2 in the assembled position.

The assembly of the connector 1 on the flexible foil 14 with the conductor 15 arranged therein can be carried out either step by step or else in a single step.

If the assembly is performed in a single step, the static friction of the pin 5 within the channel 3 and also the forces occurring when the contact pin 5 passes through the foil 14 and also the conductor 15 can be set such that the housing 2, under the action of an assembly tool moving downwards in the direction of the arrow A, remains in its transport mount until the pins 5 bear on the opening 17 or the thinned region 19, and thus fix the foil 14 with the conductor 13 within the receptacle 16, after which the housing 2 is displaced out of the transport mount downwards in such a way that the holding devices 8, 9, 10, 11 pass through openings in a circuit board or into an assigned receptacle, the conical regions of the holding devices 9, 11 leading to self-centering adjustments. Afterwards, as a result of the mechanically fixed bearing of the housing 2 on the circuit board or in the assigned receptacle, the increased forces during the closing of the first strain-relief means and also the widening of the electrical conductor 15 and of the flexible foil 14 can be absorbed by the circuit board or the assigned receptacle. The electrical connection to the circuit board is subsequently produced by the contact pin 5.

It is alternatively possible, in the manner according to the invention, for a connector which has already been prefabricated with the flexible foil to be pressed out of the transport mount and inserted into the circuit board.

REFERENCE SYMBOLS

1 Electrical connector
2 Dielectric housing
3,4 Channel
5 Contact pin
6,7 Guide channels of the transport device.
8,9,10,11 Holding devices
12 Depression
13 First strain-relief means
14 Flexible foil
15 Electrical conductor
16 Receptacle
17 Opening
18 Stop
19 Thinned region
20 Annular shoulder
21 Contact region
22 Constriction or sealing means
23 Rider
24 Latching lug
25 L-shaped section

What is claimed is:

1. Electrical connector for establishing a connection to at least one conductor essentially arranged in a flexible foil, comprising:

a dielectric housing with a receptacle for the insertion of the flexible foil and of the at least one conductor, at least one contact pin (5) for establishing an electrical contact to the at least one conductor (15), wherein the contact pin exerts a force on the electrical conductor (15) which force exerted by the contact pin (5) ensures both a mechanical bearing of the conductor (15) on the contact pin (5), and the provision of the electrical contact, and a first device (13) which comprises an essentially annular region of the connector and forms a strain relief for mechanically holding the conductor (15) or the foil (14) together with the conductor (15) such that the conductor (15) or the foil (14) together with the conductor (15) is mechanically held by the essentially annular region (13) of the connector as the contact pin (5) is pressed in.

2. Electrical connector according to claim 1, characterized in that the contact pin penetrates the electrical conductor, or the electrical conductor (15) and a section of the flexible foil, in such a way that an essentially defined flexure of the conductor and/or of the flexible foil is produced.

3. Electrical connector according to claim 1, characterized in that, with the contact pin (5) assembled, the conductor (15) or the conductor (15) together with the flexible foil (14) bear both on the contact pin (5) and on an annular shoulder (20) of the dielectric housing (2).

4. Electrical connector according to claim 1, characterized by a receptacle (16) and in that the first device (13) for the purpose of holding comprises a lateral shoulder (13) wherein when at least one contact pin (5) is pressed in, the lateral shoulder (13) is pressed downward and to the side in such a way that a press fit is brought about between the connector and the electrical conductor of the flexible foil (14) within the receptacle (16).

5. Electrical connector according to claim 1, characterized in that the contact pin, when in the assembled state, is arranged such that it passes through an opening or a thinned portion in the foil and in the conductor.

6. Electrical connector according to claim 1, characterized in that the contact pin is constituted to have a conical or pointed profile, at least at its end which faces toward the electrical conductor (15) prior to assembly.

7. Electrical connector according to claim 6, characterized in that the contact pin (5), when in the assembled state, is arranged such that it passes through a conductor section (19) not provided with an opening.

8. Electrical connector according to claim 1, further characterized by a second device for strain relief.

9. Electrical connector according to claim 8, characterized in that the second device (23, 24) for strain relief is arranged such that it is displaceable in the same direction as the contact pin (5), and produces a defined flexure of the flexible foil (14) in a strain-relieving assembly position.

10. Electrical connector according to claim 8, characterized in that the second device for strain relief has latching elements which hold a rider of the second strain-relief means in the assembled strain-relieving position.

11. Electrical connector according to claim 1, characterized in that both the contact pin (5) and a second device (23, 24) for strain relief are assigned in a preassembled position, from which preassembled position both the second strain relief device (23, 24) and the contact pin (5) can be brought into their assembled position in the same direction.

12. Electrical connector according to claim 1, characterized by a channel (3) in the dielectric housing (2) of the connector (1) for the purpose of retaining the at least one contact pin (5) in static friction with a wall of the channel.

13. Electrical connector according to claim 1, further characterized by holding devices (9, 10, 11) for positionally fixing and permanently securing the connector (1) on an assigned circuit board, which holding devices project on the underside of the housing of the connector with their longitudinal axes in the displacement direction of the contact pin (5), and whose end which is remote from the housing carries a latching device.

14. Electrical connector according to claim 1, further characterized by at least one device (6, 7) for engaging a lateral transport mounting on the connector, which transport mounting can be released by a displacement of the housing of the electrical connector (1).

15. The electrical connector according to claim 1, wherein the first device (13) that forms a strain relief comprises an annular circumferential shoulder (13) that constricts an inside width of a channel (3) in the dielectric housing (2) of the connector (1) and widens downward and to the side as the contact pin (5) is pressed into the channel (3).

16. Method for establishing an electrical connection between a flexible foil (14) carrying an electrical conductor (15) and a connector (1), the connector having a dielectric housing with a receptacle for insertion of a flexible foil and at least one conductor, at least one contact pin (5) for establishing an electrical contact to the conductor (15), and a first device (13) which comprises an essentially annular region of the connector and forms a strain relief for mechanically holding the conductor (15) or a foil (14) together with the conductor (15), comprising:

pressing the contact pin (5) from a preassembled position into an assembled position, a defined deformation being introduced into at least one region of the electrical conductor (15) or the electrical conductor (15) with the flexible foil (14), a permanent electrical connection being formed between the contact pin (5) and the electrical conductor (15), and during at least a portion of the process of pressing the contact pin (5) in, bringing the first device (13), forming strain relief, for the purpose of holding, from its preassembled position into its assembled, strain-relieving position.

17. Method for establishing an electrical connection according to claim 16, characterized in that during at least part of the pressing-in operation, bringing a second strain-relief device (23, 24) from a preassembled position into an assembled and latched, strain-relieving position.

18. Method for establishing an electrical connection according to claim 16, characterized by pushing the contact pin at one end of the dielectric housing and into an assigned opening in a printed circuit board.

19. Method for establishing an electrical connection according to claim 16, characterized by pushing the electrical connector out of a transport mounting before, during and after one of the method steps of claims 16–18.

20. Method for establishing an electrical connection according to claim 19, characterized in that the electrical connector (1), after being pushed out of the transport mounting, is brought with its holding devices for positional fixing into assigned receptacle devices for latched retention.

21. Method for establishing an electrical connection according to claim 16, characterized by carrying out all the method steps of claims 16–20 in a single operation.

22. Method for establishing an electrical connection according to claim 21, characterized in that the coefficients of static friction of longitudinally displaceable elements of the connector (1) and forces of the contact pin (5) when passing through the conductor (15) or through the conduct (15) together with the foil (14), displacement of longitudinally displaceable elements of the connector (1), produce a defined sequence of method steps.

23. Method according to claim 21, characterized in that all the method steps of claims 15–19 are carried out in a single displacement operation.

* * * * *